United States Patent [19]

Hinz et al.

[11] Patent Number: 4,989,825

[45] Date of Patent: Feb. 5, 1991

[54] SUPPORT MEANS FOR SUPPORTING CALENDER ROLLS

[75] Inventors: Joachim Hinz, Tettnang; Josef Schneid, Vogt; Wolf-Gunter Stotz, Ravensburg; Werner Schmid, Bliezhausen, all of Fed. Rep. of Germany

[73] Assignee: Sulzer-Escher Wyss GmbH, Ravensburg, Fed. Rep. of Germany

[21] Appl. No.: 341,332

[22] Filed: Apr. 21, 1989

[30] Foreign Application Priority Data

Apr. 28, 1988 [CH] Switzerland ..... 01591/88

[51] Int. Cl.[5] ..... F16M 1/00; B30B 3/04

[52] U.S. Cl. ..... 248/676; 100/161

[58] Field of Search ..... 248/676; 100/161, 162 R, 100/163 R, 162 B, 163 A, 168, 170; 425/186

[56] References Cited

U.S. PATENT DOCUMENTS

| | | | |
|---|---|---|---|
| 1,587,784 | 6/1926 | Mahler | 100/162 R X |
| 2,501,585 | 3/1950 | Schnuck | 100/163 R |
| 3,111,894 | 11/1963 | Murray | 100/162 R |
| 3,158,088 | 11/1964 | Seidel | 100/163 R |
| 3,331,313 | 7/1967 | Notbohm | 100/162 R X |
| 3,333,533 | 8/1967 | Agronin | 100/162 R |
| 3,340,796 | 9/1967 | Link | 100/162 R |
| 3,777,656 | 12/1973 | Muller | 100/163 A X |
| 4,311,091 | 1/1982 | Pav | 100/161 |
| 4,347,784 | 9/1982 | Pay | 100/162 R |
| 4,510,859 | 4/1965 | Berry | 100/162 R X |

*Primary Examiner*—J. Franklin Foss

*Attorney, Agent, or Firm*—Sandler, Greenblum & Bernstein

[57] ABSTRACT

Support components or supports for supporting calender rolls for treating web-shaped materials comprise walls which surround a roll stand of the calender and are slidably arranged at guideways provided at the roll stand. Each support component supports an associated calender roll having a predetermined diameter, and a predetermined support length of each support component in a predetermined direction of the guideways is greater than the predetermined diameter of the associated calender roll. The walls of adjacent support components define a predetermined numbr of pairs of mutually facing edges. At least one pair of mutually facing edges between two adjacent support components contains projections and complementary shaped recesses. When such two adjacent support components are slidably displaced toward one another, the projections extend into the correspondingly structured complementary shaped recesses. By virtue of the predetermined support length of the support components being greater than the average predetermined roll diameter, there is substantially prevented a canting or jamming of the support components during displacement thereof along the guideways.

10 Claims, 2 Drawing Sheets

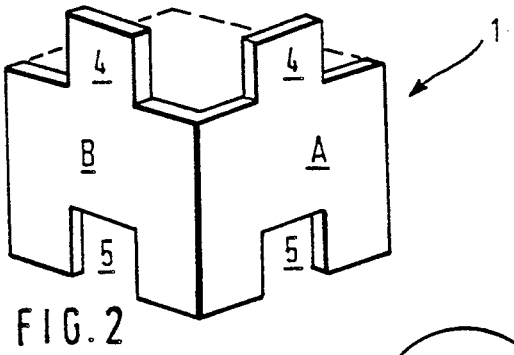
FIG. 2
FIG. 1
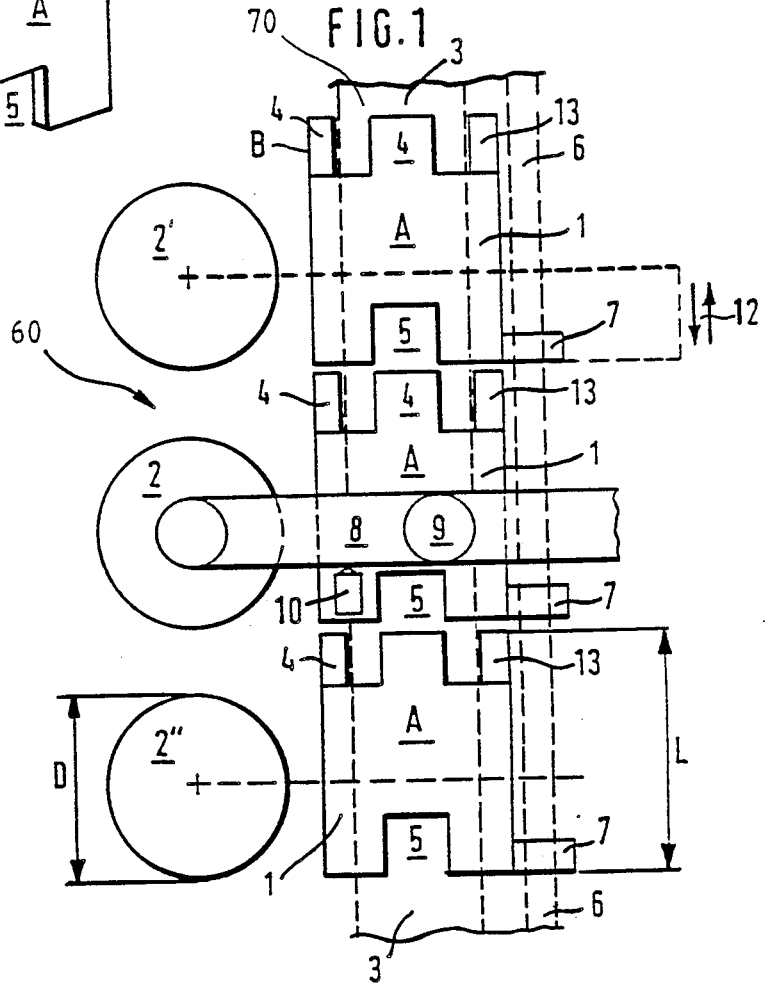
FIG. 3
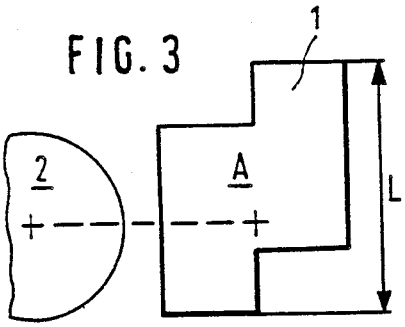
FIG. 4
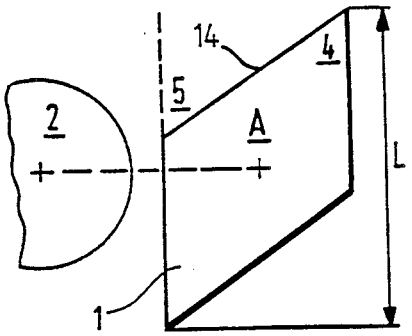

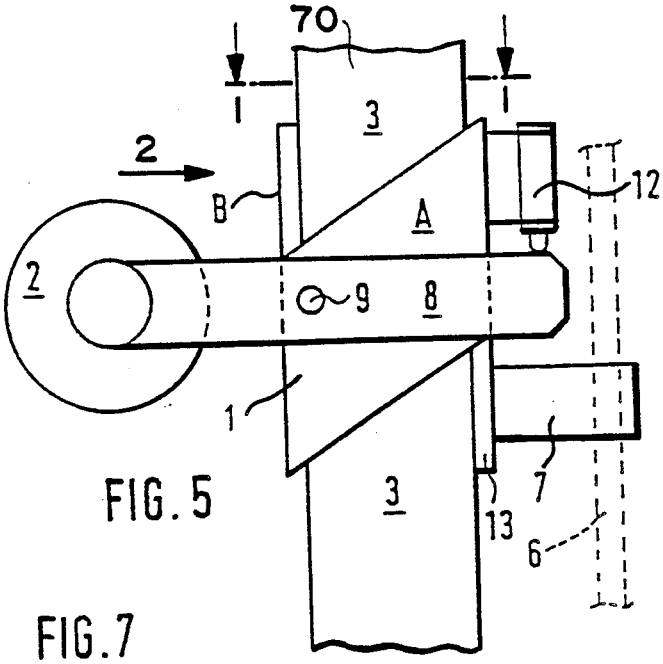
FIG. 5
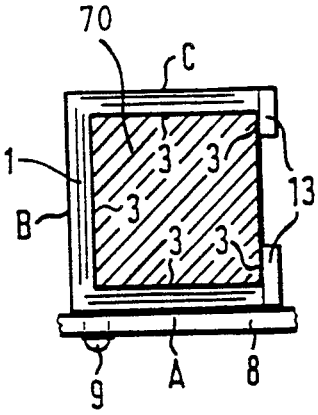
FIG. 6
FIG. 7
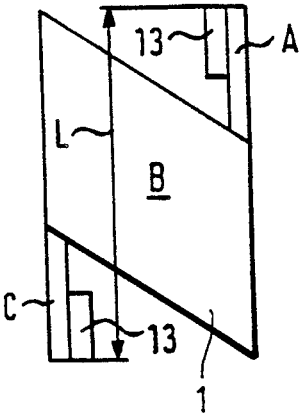
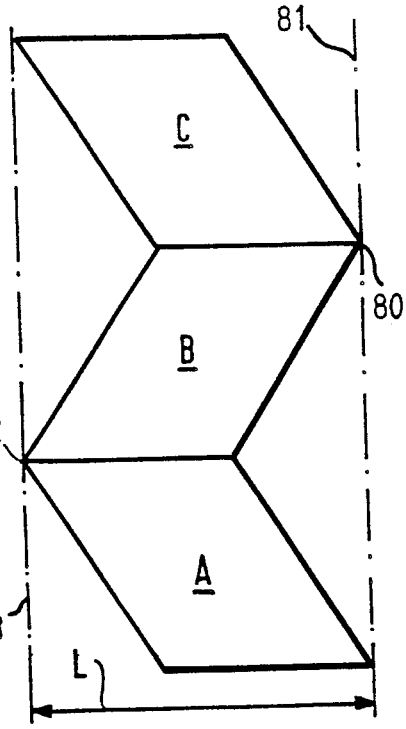
FIG. 8
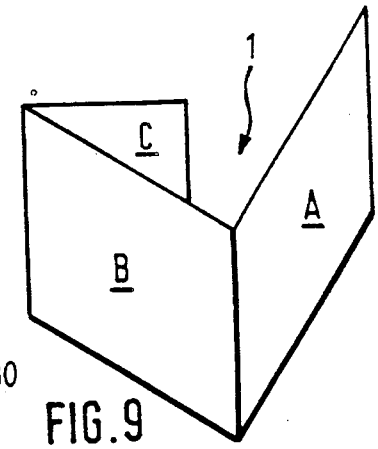
FIG. 9
FIG. 10
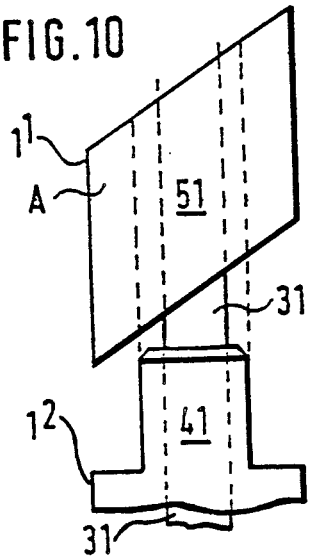
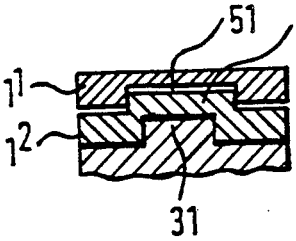
FIG. 11

SUPPORT MEANS FOR SUPPORTING CALENDER ROLLS

BACKGROUND OF THE INVENTION

The present invention broadly relates to the positioning of rolls or rollers in a calender roll stack and, more specifically pertains to a new and improved construction of support means for supporting calender rolls or rollers for treating substantially web-shaped materials.

Generally speaking, the support means of the present invention comprise walls which surround a roll stand of the calender and are slidably arranged at guideways or guide tracks provided at the roll stand.

Constructions of such support or carriage components known to the art comprise walls which have edges extending substantially perpendicular to the direction of the guideways or guide tracks. There is thus defined in this direction of the guideways or guide tracks a predetermined support length of the support or carriage components. This support length is adapted or matched to the diameter of the associated roll or roller to be supported by the support or carriage component and is normally shorter than the respective roll diameter. Such a support or carriage component can also support a roll or roller having a diameter which is smaller than the support length of the related support or carriage component. However, if the neighboring or adjacent roll or roller does not possess a sufficiently large diameter, two such rolls or rollers cannot be displaced relative to each other into a working or operational position, because the mutually facing or confronting edges of the neighboring or adjacent support or carriage components come to bear upon each other, while the associated neighboring or adjacent rolls or rollers are still apart. On the other hand, it is often the case that the possible or constructible support length of the support or carriage components is too short, so that a canting can occur while moving the support or carriage components along the guideways or guide tracks. Such canting can seriously impair the desired low-friction sliding guidance of the support or carriage components at the roll stand.

SUMMARY OF THE INVENTION

Therefore, with the foregoing in mind, it is a primary object of the present invention to provide new and improved support means for supporting calender rolls and which do not suffer from the aforementioned drawbacks and shortcomings of the prior art constructions.

Another and more specific object of the present invention aims at providing new and improved support means for supporting calender rolls and which, on the one hand, improve the operational possibilities of the support and carriage components such that calender rolls or rollers which possess relatively small diameters also can be smoothly displaced to bear upon each other and, on the other hand, substantially prevent canting of the support or carriage components during sliding displacement thereof at the guideways or guide tracks provided at the roll stand.

Yet a further significant object of the present invention aims at providing new and improved support or carriage components for supporting calender rolls or rollers and which are relatively economical to manufacture and yet afford highly reliable operation without generally being subject to malfunction, and also require practically no maintenance or servicing.

Now in order to implement these and still further objects of the present invention which will become more readily apparent as the description proceeds, the support means for supporting calender rolls or rollers of the present invention are manifested, among other things, by the features that such support means comprise at least two adjacent or neighboring support or carriage components or supports, the walls of which possess a predetermined number of pairs of mutually facing or confronting edges, at least one pair of mutually facing or confronting edges having a complementary shape. Each of the at least two adjacent or neighboring support or carriage components or supports defines a predetermined support length in the predetermined direction of the guideways or guide tracks and such predetermined support length is greater than the predetermined diameter of the associated calender roll or roller. Means are provided for slidably displacing the at least two adjacent or neighboring support or carriage components or supports relative to each other for interengagement of the at least one pair of complementary shaped mutually facing or confronting edges.

The at least one pair of complementary shaped mutually facing or confronting edges advantageously contain engagement members. Such engagement members can be constructed as projections or protrusions and complementary shaped recesses which are formed at the at least one pair of mutually facing or confronting edges.

The walls of the at least two support components or supports, which walls contain the projections or protrusions and complementary shaped recesses at the at least one pair of mutually facing or confronting edges, are preferably constructed according to a common predetermined pattern. These walls can be substantially symmetrically arranged with respect to the roll stand or the guideways or guide tracks thereof.

On the other hand, the walls of the at least two support components or supports can also be substantially asymmetrically arranged with respect to the roll stand or the guideways or guide tracks thereof. The projections or protrusions and complementary shaped recesses formed at the at least one pair of mutually facing or confronting edges can be constructed along an imaginary line which substantially extends at an inclination to the predetermined direction of the guideways or guide tracks at the roll stand.

According to a further exemplary embodiment of the guide means, the engagement or coacting members can be constructed as a substantially tunnel-shaped recess and a complementary projection or protrusion. The complementary projection or protrusion engages with and moves into the substantially tunnel-shaped recess upon displacement of the at least two support or carriage components or supports relative to each other.

By virtue of the support length of the support or carriage components or supports being greater than the average diameter of the respective calender rolls or rollers, canting is substantially prevented when the support or carriage components or supports are slidably displaced along the guideways or guide tracks or rails at the roll stand. On the other hand, it is possible, despite the greater support length of the support or carriage components or supports, to allow calender rolls or rollers having diameters smaller than the respective support lengths to cooperate with or engage each other, without the engagement or coacting members of the complementary shaped mutually facing or confronting edges totally interengaging with one another.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 1 schematically illustrates in side view a multi-roll calender comprising support or carriage components or supports constructed according to the invention and mounted at a roll stand;

FIG. 2 schematically shows an isometric illustration of one of the support or carriage components or supports depicted in FIG. 1;

FIG. 3 schematically shows a second exemplary embodiment of the support or carriage component or support constructed according to the invention;

FIG. 4 schematically shows a third exemplary embodiment of the support or carriage component or support constructed according to the invention;

FIG. 5 schematically illustrates in side view the third exemplary embodiment of the support or carriage component or support mounted at the roll stand;

FIG. 6 is a schematic top plan view and a section substantially along the line I—I in FIG. 5;

FIG. 7 is a lateral view looking in the direction of the arrow II in FIG. 5;

FIG. 8 illustrates in a developed or cut-away view the form and arrangement of the walls of the third exemplary embodiment of the, support or carriage component or support depicted in 4 and 5;

FIG. 9 s the walls in FIG. 8 in an isometric illustration depicting the walls as arranged to surround or embrace the roll stand;

FIG. 10 schematically shows a fourth exemplary embodiment of a support or carriage component or support comprising a wall having a substantially tunnel-shaped recess, and a portion of a neighboring or adjacent support or carriage component or support having a projection or protrusion complementary to the tunnel-shaped recess; and FIG. 11 a section through the projection or protrusion in FIG. 10, such projection or protrusion being shown in interengagement with the substantially tunnel-shaped recess.

DETAILED DESCRIPTION OF THE PREFERRED EMBODIMENTS

Describing now the drawings, it is to be understood that to simplify the showing thereof, only enough of the support means for supporting calender rolls has been illustrated therein as is needed to enable one skilled in the art to readily understand the underlying principles and concepts of this invention. Turning attention now specifically to FIG. 1 of the drawings, a schematically depicted roll calender 60 comprises an intermediate roll or roller 2 which is arranged between an upper adjacent roll or roller 2' and a lower adjacent roll or roller 2".

In FIG. 1 the roll calender 60 is conveniently schematically depicted only from one side to facilitate the illustration and improve clarity thereof It is to be understood that a mirror-image arrangement of that shown in FIG. 1 also is present at the oppositely situated side of the roll calender 60.

Support or carriage components or supports 1 for the intermediate roll or roller 2, the upper adjacent roll or roller 2' and the lower adjacent roll or roller 2" of the roll calender 60 each comprise walls A, B and C, which walls surround or embrace a schematically illustrated roll stand 70 and are slidably arranged at guideways or guide tracks or rails 3 provided at the roll stand 70 of the roll calender 60. In FIG. 1, only the surface of one lateral guideway or track or rail 3 is visible in the plane of the drawing. The support or carriage components or supports 1 possess a support length L which is greater than the diameter D of the calender rolls or rollers 2, 2' and 2". The walls A, B and C of the intermediate support or carriage component 1 of the intermediate roll or roller 2 form pairs of mutually facing or confronting edges with the associated walls A, B and C of the upper adjacent support or carriage component or support 1 and the lower adjacent support or carriage component or support 1, respectively.

Projections or protrusions 4 are formed or structured at the mutually facing or confronting edges of the walls A, B and C. These projections or protrusions 4 can interengage with correspondingly structured complementary recesses 5 when the support or carriage components 1 are slidably displaced relative to each other. It is apparent from FIG. 1 that the rolls or rollers 2, 2' and 2" can be moved into a working or operational position, although the support length L is greater than the average diameter D of the rolls or rollers 2, 2' and 2".

As is known to the art, there is provided a drive spindle 6 for moving the support or carriage components or supports 1 along the roll stand 70. Each support or carriage component or support 1 is coupled to the drive spindle 6 by means of a connecting or coupling device 7, so that each support or carriage component or support 1 can be retained or locked in a desired position at the roll stand 70.

The rolls or rollers 2, 2' and 2" are supported at the support or carriage components 1 by means of an associated pivotably mounted lever or lever member 8. In FIG. 1 the lever or lever member 8 is schematically depicted only for the intermediate roll or roller 2 to facilitate the illustration and improve clarity thereof. This lever or lever member 8 is rotatably mounted at a pivot or fulcrum 9 at the related support or carriage component or support 1. For additional support or displacement of the lever or lever member 8 relative to the support or carriage component or support 1, there is provided, in known manner, a support structure or unit 10. In case the lever or lever member 8 is constructed as a double- or two-armed lever, the support structure or unit 10 also can be arranged or provided at the lever arm remote from the associated roll or roller 2, as schematically indicated by broken lines and by double arrows 12 in FIG. 1. The support structure or unit 10, on the one hand, is secured at the associated support or carriage component or support 1 and, on the other hand, acts upon the related lever or lever member 8.

As depicted in FIG. 6, the roll stand 70 conveniently possesses a prismatic or prismoidal shape having four surfaces or sides, at which four guideways or guide tracks 3 are formed or structured The three walls A, B and C of the support or carriage component or support 1 surround the roll stand 70 from three sides. In order to hold and retain the support or carriage component or support 1 at the rear guideway or guide track 3 as viewed from the rolls or rollers 2, 2' and 2'', there are provided guide shoes or blocks 13. The arrangement of such guide shoes or blocks 13 corresponds with the support length L of the support or carriage components or supports 1.

As depicted in FIGS. 1 and 2, the three walls A, B and C containing the projections or protrusions 4 and the recesses 5 are all constructed according to a common pattern and symmetrically arranged with respect to the roll stand 70 or the guideways or guide tracks 3.

On the other hand, these walls A, B and C of the support or carriage component 1 can be structured according to an asymmetric pattern as shown in FIGS. 3 and 4. For example, the lateral walls A and C can be structured and arranged in mirror-image fashion, while the front or central wall B is structured according to the symmetrical pattern depicted in FIGS. 1 and 2.

In FIG. 4 there is illustrated a particularly advantageous embodiment of a wall which in this case is the lateral wall A. The projection or protrusion 4 and the complementary recess 5 are provided along an edge 14 which inclinedly extends with respect to the direction of the guideway or guide track 3. The construction of a support or carriage component or support 1 possessing walls A, B and C as depicted in FIG. 4 and allowing for a particularly elongated support length L is shown in FIGS. 5 through 9. As particularly well depicted in the developed or cut-away view of the walls A, B and C in FIG. 8, these walls A, B and C are alternately ascending or descending relative to one another. The upper tips or peaks 80 of the walls A, B and C extend up to a first plane 81 and the lower tips or peaks 82 of the walls A, B and C extend up to a second plane 83. The distance or spacing between these planes 81 and 83 defines the support length L of the asymmetric support or carriage component 1. Such a wall arrangement offers a particularly large range of formative or creative freedom in the design of the support or carriage component or support 1.

A further advantageous exemplary embodiment of a support or carriage component or support constructed according to the invention is depicted in FIGS. 10 and 11. A support or carriage component $1^1$ is provided with a substantially tunnel-shaped recess 51. A neighboring or adjacent support or carriage component $1^2$ comprises a projection or protrusion 41 which is complementarily constructed to the recess 51. When the support or carriage components or supports $1^1$ and $1^2$ are slidably displaced relative to each other, the projection or protrusion 41 extends into the tunnel-shaped recess 51. For this particular design of the support or carriage components or supports $1^1$ and $1^2$ it is advantageous to provide a separate guideway for each of the supports or carriage components or supports $1^1$ and $1^2$. For example, a guide track 31 is provided for the lower support or carriage component or support $1^2$ containing the projection or protrusion 4. It is also conceivable that the support or carriage component or support $1^2$ may be provided with projections or protrusions 4 at the upper and lower edges of the walls A, B and C, such that both adjacent or neighboring supports or carriage components or supports $1^1$ are provided with complementary tunnel-shaped recesses 51.

While there are shown and described preferred embodiments of the invention, it is to be distinctly understood that the invention is not limited thereto, may be otherwise variously embodied and practiced within the scope of the following claims. ACCORDINGLY,

What we claim is:

1. Support means for supporting rolls of a calender for treating substantially web-shaped materials, comprising:

a roll stand;

at least two supports containing walls which surround said roll stand of the calender;

said roll stand being provided with guideways extending in a predetermined direction for slidably guiding said at least two supports at said roll stand;

two adjacent ones of said at least two supports possessing a predetermined number of pairs of mutually facing edges;

at least one pair of said predetermined number of pairs of mutually facing edges being substantially complementary shaped;

means for slidably displacing at least said two adjacent supports relative to each other for interengagement of said at least one pair of substantially complementary shaped mutually facing edges;

each one of said two adjacent supports supporting an associated calender roll having a predetermined diameter; and each one of said at least two supports defining a predetermined support length greater than said predetermined diameter of said associated calender roll and extending in said predetermined direction of said guideways.

2. The support means as defined in claim 1, wherein:

said at least one pair of substantially complementary shaped mutually facing edges contains engagement members; and said engagement members comprising projections and substantially complementary shaped recesses formed at said at least one pair of mutually facing edges.

3. The support means as defined in claim 2, wherein:

said walls of said at least two supports and containing said projections and said substantially complementary shaped recesses at said at least one pair of mutually facing edges are constructed according to a common predetermined pattern.

4. The support means as defined in claim 3, wherein:

said walls of said at least two supports are substantially symmetrically arranged with respect to said roll stand.

5. The support means as defined in claim 3, wherein:

said walls of said at least two supports are substantially symmetrically arranged with respect to said guideways for slidably guiding said at least two supports at said roll stand.

6. The support means as defined in claim 3, wherein:

said walls of said at least two supports are substantially asymmetrically arranged with respect to said roll stand.

7. The support means as defined in claim 3, wherein:

said walls of said at least two supports are substantially asymmetrically arranged with respect to said guideways for slidably guiding said at least two supports at said roll stand.

8. The support means as defined in claim 7, said projections and said substantially complementary shaped recesses formed at said at least one pair of mutually facing edges are constructed along an imaginary line which substantially inclinedly extends with respect to said predetermined direction of said guideways at said roll stand.

9. The support means as defined in claim 1, wherein:

said at least one pair of substantially complementary shaped mutually facing edges contains engagement members;

said engagement members being constructed as a substantially tunnel-shaped recess and a protrusion; and protrusion engaging with said substantially tunnel-shaped recess upon displacement of said at least two supports relative to each other.

10. The support means as defined in claim 9, wherein:

one of said at least two supports contains said protrusion engaging with said substantially tunnel-shaped recess; and said guideway of said one of said at least two supports being constructed as a guide track for said protrusion engaging with said substantially tunnel-shaped recess.

* * * * *

UNITED STATES PATENT AND TRADEMARK OFFICE

CERTIFICATE OF CORRECTION

PATENT NO. : 4,989,825

DATED : February 5, 1991

INVENTOR(S) : Joachim HINZ et al.

It is certified that error appears in the above-identified patent and that said Letters Patent is hereby corrected as shown below:

On the cover page, in line 11 of the Abstract of the printed patent, change "numbr" to ---number---.

In column 3, line 38 of the printed patent, before "the", change "s" to ---shows---.

In column 3, line 48 of the printed patent, before "a", insert ---is---.

In column 3, line 67 of the printed patent, after "thereof", insert ---.---.

In column 6, line 64 of the printed patent, after "claim 7,", insert ---wherein---.

In column 8, line 1 of the printed patent, before "protrusion", insert ---said---.

Signed and Sealed this

First Day of September, 1992

*Attest:*

*Attesting Officer*

DOUGLAS B. COMER

*Acting Commissioner of Patents and Trademarks*